US008460027B2

(12) United States Patent
Topolewski

(10) Patent No.: US 8,460,027 B2
(45) Date of Patent: Jun. 11, 2013

(54) INTERLOCK FOR AN ELECTRICAL SYSTEM

(75) Inventor: John N. Topolewski, Westlake, MI (US)

(73) Assignee: Lear Corporation, Southfield, MI (US)

( * ) Notice: Subject to any disclaimer, the term of this patent is extended or adjusted under 35 U.S.C. 154(b) by 226 days.

(21) Appl. No.: 13/099,452

(22) Filed: May 3, 2011

(65) Prior Publication Data

US 2012/0281342 A1 Nov. 8, 2012

(51) Int. Cl.
*H01R 31/08* (2006.01)

(52) U.S. Cl.
USPC ..... 439/511; 439/911

(58) Field of Classification Search
USPC ..... 439/510–511, 507, 911
See application file for complete search history.

(56) References Cited

U.S. PATENT DOCUMENTS

| | | | | |
|---|---|---|---|---|
| 5,504,655 | A | 4/1996 | Underwood et al. | |
| 5,971,801 | A * | 10/1999 | Kato et al. | 439/511 |
| 6,087,737 | A | 7/2000 | Alksnat et al. | |
| 6,196,858 | B1 * | 3/2001 | Matsumoto et al. | 439/354 |
| 6,668,963 | B2 | 12/2003 | Nada | |
| 7,084,361 | B1 | 8/2006 | Bowes et al. | |
| 7,402,068 | B1 | 7/2008 | Tarchinski | |

* cited by examiner

*Primary Examiner* — Xuong Chung Trans
(74) *Attorney, Agent, or Firm* — MacMillan, Sobanski & Todd, LLC

(57) ABSTRACT

An interlock for use with an electrical system includes an electrical component that is supported on a support structure. A first member is removably secured to the support structure. The first member prevents contact with the electrical component while the first member is secured to the support structure. A second member is also removably secured to the support structure. The second member prevents removal of the first member while the second member is secured to the support structure. The electrical component is adapted to be connected to a power source only when both the first member and the second member are secured to the support structure.

18 Claims, 4 Drawing Sheets

INTERLOCK FOR AN ELECTRICAL SYSTEM

BACKGROUND OF THE INVENTION

This invention relates in general to electrical systems, such as are commonly used in electrically powered vehicles and the like. In particular, this invention relates to an improved interlock for providing safe access to an electrical system that is cost effective and relatively simple in structure.

Vehicles that utilize electricity as a source of power, such as electric, fuel cell, and hybrid vehicles, often employ an electrical system. A typical electrical system includes a power source that is connected to a device, such as an electric motor controller. The electrical system may further include various electrical components including, for example, fuses, inductors, capacitors, and the like. It is known that some of these electrical components (e.g., capacitors) are capable of storing electrical energy and, therefore, may need to be discharged in order to be safely handled after being disconnected from the power source. Thus, it is known that the power source should be disconnected from the electrical system, and that the stored electrical energy be discharged from the electrical components before contact with such electrical components should occur.

For increased safety, the electrical system may be provided with an interlock that is configured to affirmatively disconnect the power source from the electrical system when access is attempted. Thus, access to the electrical components is affirmatively prevented unless the power source has been disconnected from the electrical system. In some instances, such interlocks are provided with a time delay feature that continues to prevent access to the electrical components for a predetermined amount of time after the power source has been disconnected from the electrical system. This predetermined time delay allows any electrical energy that is stored in the electrical components to be sufficiently discharged for safe handling.

One known example of such an interlock includes a protective cover that is secured to a device in an electrical system by a plurality of threaded fasteners. Access to at least one of the threaded fasteners is prevented by a shroud that, in turn, is electrically coupled to a control circuit. To gain access to the threaded fastener for removal of the protective cover, the shroud must first be detached. Detachment of the shroud is detected by the control circuit which, in response thereto, initiates the disconnection of the power source from the electrical components in the electrical system. A predetermined amount of time (such as a few seconds, for example) elapses as the threaded fastener and the protective cover are subsequently removed, thereby allowing a sufficient amount of time for the electrical components to discharge.

Although known interlocks function in an acceptable manner, such systems may employ devices that are relatively costly and that can be either difficult to assemble and disassemble or that can be incorrectly re-assembled after servicing. Thus, it would be desirable to provide an improved interlock for providing safe access to an electrical system that is cost effective and relatively simple to assemble and disassemble.

SUMMARY OF THE INVENTION

This invention relates to an interlock for use with an electrical system. The interlock includes an electrical component that is supported on a support structure. A first member is removably secured to the support structure. The first member prevents contact with the electrical component while the first member is secured to the support structure. A second member is also removably secured to the support structure. The second member prevents removal of the first member while the second member is secured to the support structure. The electrical component is adapted to be connected to a power source only when both the first member and the second member are secured to the support structure.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
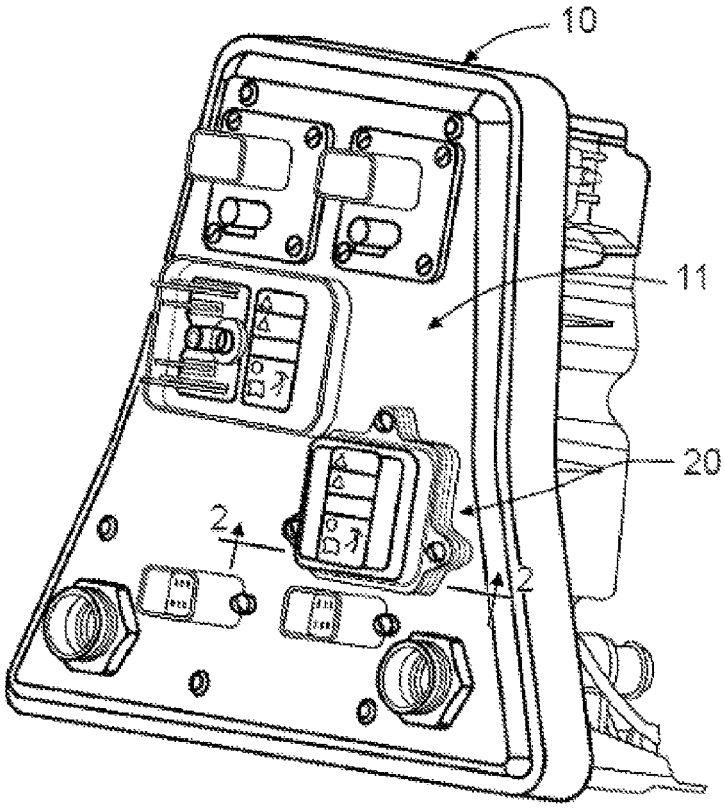
FIG. 1 is a perspective view of an electrical system including an interlock in accordance with this invention shown in a fully assembled and closed circuit position.

Referring now to the drawings, there is illustrated in FIG. 1 an electrical system, indicated generally at 10, in accordance with this invention. In the illustrated embodiment, the electrical system 10 is a high voltage battery bulkhead distribution unit that can be used, for example, in an electrically powered vehicle (not shown). However, the illustrated electrical system 10 is intended merely to demonstrate one environment in which this invention may be used. Thus, the scope of this invention is not intended to be limited for use with the specific structure of the electrical system 10 illustrated in FIG. 1 or with electrical systems in general. On the contrary, it will be appreciated that this invention may be used in any desired environment for the purposes described below.

Figure 8:
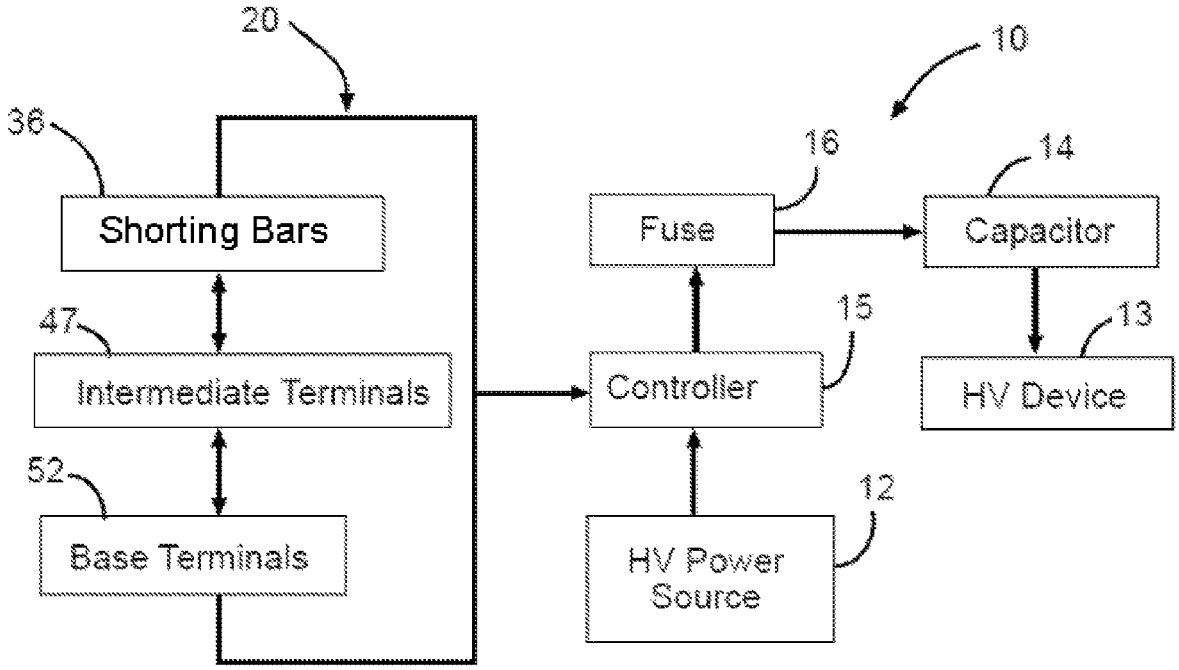
FIG. 8 is a block diagram of an electrical circuit of the interlock and the electrical system illustrated in FIGS. 1 through 7.

The illustrated electrical system 10 includes a panel 11 or other support structure upon which a variety of conventional electrical components, connectors, cooling connections, and the like are supported. For example, as shown in FIG. 8, the electrical system 10 can include a high voltage power source 12, a high voltage device 13, a capacitor 14, a controller 15, and one or more fuses 16, all of which are conventional in the art. It should be appreciated, however, that the electrical system 10 may include any number and configuration of electrical components for any desired application.

At times, it may be necessary to access one or more of the electrical components of the electrical system 10 (such as the fuse 16, for example) for servicing and/or replacement. However, it is known that some or all of the electrical components in the electrical system 10 may be capable of storing electrical energy (such as the capacitor 14, for example). Therefore, it is desirable that the electrical system 10 be discharged after being disconnected from the power source 12 in order to allow safe handling. As such, it is usually desirable that the power source 12 be disconnected from the electrical system 10 and any electrical energy stored in the electrical components be discharged therefrom before servicing or otherwise handling of the electrical components occurs.

To accomplish this, the illustrated electrical system 10 includes an interlock, indicated generally at 20, in accordance with this invention. The illustrated interlock 20 is embodied as an access panel or similar structure that is adapted to automatically disconnect the power source 12 from the electrical system 10 when the panel is removed to access a desired electrical component. The illustrated interlock 20 also prevents access to the desired electrical component for a predetermined minimum amount of time so as to allow any electrical energy stored in the electrical components to be discharged therefrom before servicing or otherwise handling of the electrical components occurs.

Figure 2:
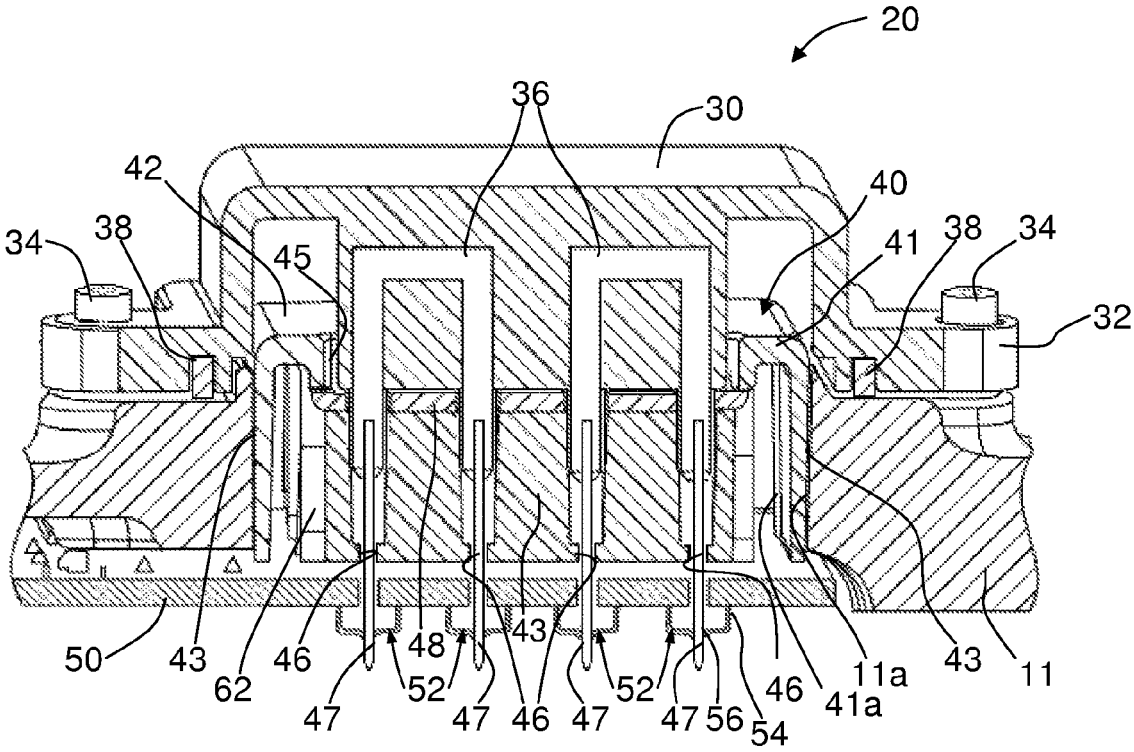
FIG. 2 is an enlarged sectional elevational view of a portion of the interlock taken along line 2-2 of FIG. 1.

The structure of the interlock 20 is illustrated in detail in FIG. 2. As shown therein, the illustrated interlock 20 includes an external cover 30 that is removably secured to the panel 11. As shown, the external cover 30 fully encloses an opening 11*a* in the panel 11, although such is not required. The external cover 30 may be formed having any desired size or shape for a desired application or to accomplish a desired purpose. The external cover 30 can be made from any desired material, but preferably is formed from an electrically non-conductive or insulating material, such as a plastic material or the like. The external cover 30 can be formed using any suitable method, such as a molding process or the like. The purposes of the external cover 30 will be further described below.

As mentioned above, the illustrated external cover 30 is removably secured to the panel 11 of the electrical system 10. To accomplish this, the external cover 30 has one or more flange portions 32 provided thereon that are adapted to receive fasteners 34, such as conventional threaded fasteners, for securing the external cover 30 to the panel 11. Alternatively, the external cover 30 can be secured to the panel 11 using retention tabs, hinges, latches, or the like. It should also be appreciated that the external cover 30 can be removably secured to any other structure of the electrical system 10 if so desired.

The interlock 20 is adapted to disconnect the power source 12 from the electrical system 10 when the external cover 30 is removed from the panel 11. To accomplish this, the external cover 30 may include any number of electrically conductive shorting bars 36 that are configured to form a portion of an interlock circuit, as will be explained below. In the illustrated embodiment, the external cover 30 includes a pair of shorting bars 36, although any number of shorting bars 36 may be used. Each of the illustrated shorting bars 36 is a flat member having a generally U-shaped configuration with a pair of distal ends. Alternatively, the shorting bar 36 can be embodied as any electrically conductive component for a desired application. As shown, the pair of shorting bars 36 are secured within a wall portion of the external cover 30 such that the distal ends protrude therefrom, the purpose of which will be explained below. However, the shorting bars 36 can be secured to any portion of the external cover 30 using any method, such as a molding process. Further, it should be appreciated that the shorting bars 36 may be formed from any electrically conductive material, including but not limited to metallic materials such as copper and the like.

The external cover 30 may also include an electromagnetic shield (not shown), although such is not required. The electromagnetic shield can be adapted to protect other electronic components that are situated on or near the electrical system 10 from electromagnetic interference caused by the electrical system 10. As such, the electromagnetic shield can be any conductive material suitable for shielding electromagnetic radiation. For example, a metallic coating or the like may be applied to an interior surface of the external cover 30.

The illustrated external cover 30 also includes a seal 38, although such is not required. The seal 38 can be configured to prevent contamination of the electrical system 10 and any components covered by the interlock 20. As shown, the seal 38 is provided within a groove that extends around a peripheral edge of the external cover 30. The seal 38 is adapted to engage an external surface of the panel 11 or any other structure of the electrical system 10. Accordingly, the seal 38 can be made of any material suitable for use in a sealing application, including but not limited to a rubber material or the like. It should be appreciated that the seal 38 can be configured in any manner for a desired application.

The illustrated interlock 20 further includes an intermediate liner assembly, indicated generally at 40, in accordance with this invention. One purpose of the intermediate liner assembly 40 is to prevent contact with the desired electrical component (or access to the electrical system 10 in general) until discharge of the electrical system 10 has occurred. To accomplish this, the intermediate liner assembly 40 can be removably secured within the opening 11*a* of the panel 11 so as to prevent contact with the desired electrical component. Alternatively, the intermediate liner assembly 40 can be removably secured to an outer surface of the panel 11 and configured to enclose the opening 11*a* if so desired. As will be explained below, removal of the intermediate liner assembly 40 from the panel 11 takes a predetermined minimum amount of time (for example, approximately five seconds) thereby allowing the components of the electrical system 10 to sufficiently discharge.

Figure 7:
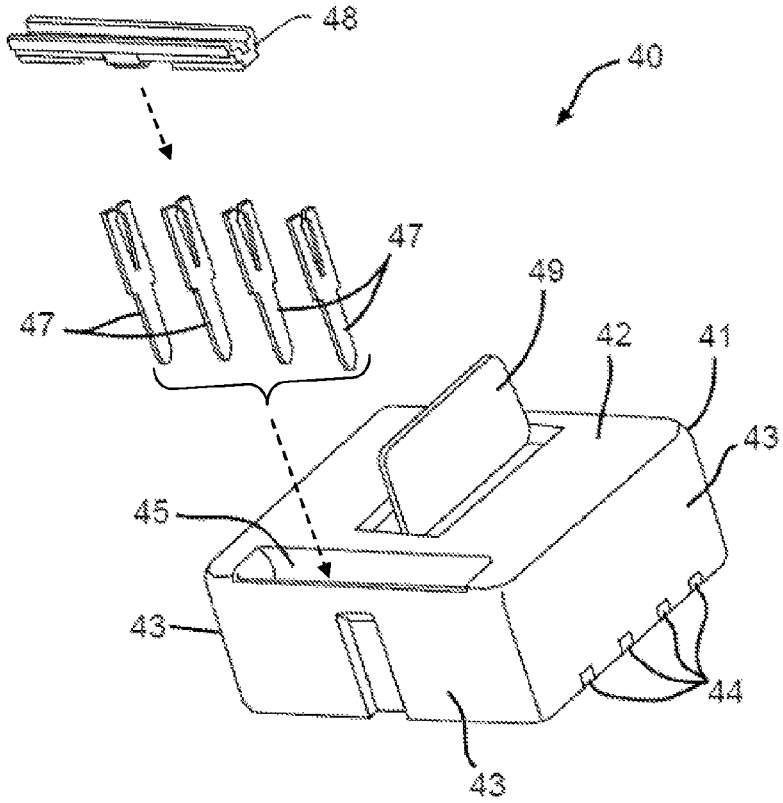
FIG. 7 is a further enlarged exploded perspective view of an intermediate liner assembly of the interlock illustrated in FIGS. 1 through 6.

Referring to FIGS. 2 and 7, the illustrated intermediate liner assembly 40 includes a housing portion 41. The housing portion 41 can include a top surface 42 and a plurality of side walls 43 thereby forming an internal region 41*a* thereof. In the illustrated position shown in FIG. 2, the side walls 43 extend into the opening 11*a* of the panel 11 such that the desired electrical component is concealed within the internal region 41*a* of the housing portion 41. The housing portion 41 may define any size or shape for a desired application or to accomplish a desired purpose. Further, the housing portion 41 can be formed from any desired material, such as an electrically non-conductive or insulating material, and can be produced using any suitable method, such as a molding process or the like.

The illustrated housing portion 41 also includes a plurality of tabs 44 (see FIG. 7) for removably securing the intermediate liner assembly 40 within the opening 11*a* of the panel 11. As shown in FIG. 7, the illustrated tabs 44 are spaced apart from one another and are located near a bottom edge of at least one of the side walls 43 of the housing portion 41. The tabs 44 may each form a resilient protrusion that extends outwardly from the associated side wall 43. Thus, when the housing portion 41 of the intermediate liner assembly 40 is inserted into the opening 11*a*, the tabs 44 are adapted to engage a bottom edge of the panel 11. Alternatively, any other structure may be provided to removably secure the housing portion 41 within the opening 11*a* of the panel 11 including, but not limited to, a lip and groove configuration or the like. As will become apparent, a conventional hand tool (not shown) may be used to remove the intermediate liner assembly 40 from the panel 11, the purpose of which will be explained below.

The illustrated housing portion 41 also has a receptacle 45 provided therein that is configured to receive a portion of the external cover 30 that includes the shorting bars 36, as will be further explained below. As shown in FIG. 7, the receptacle 45 extends downwardly from the top surface 42 into one of the side walls 43, thereby forming an internal cavity. It will be appreciated that the receptacle 45 may be any size or shape for a desired application or to accomplish a desired purpose.

Referring back to FIG. 2, the side wall 43 in which the receptacle 45 is provided may further include a plurality of passageways 46. As shown, the passageways 46 extend from the internal cavity of the receptacle 45 through a bottom surface of the side wall 43. The passageways 46 may form narrow slits for individually receiving and securing intermediate terminals 47 therein, as will be explained below. It should also be appreciated, however, that the passageways 46 may be any size or shape for a desired application or to accomplish a desired purpose.

The intermediate terminals 47 of the intermediate liner assembly 41 are preferably formed from an electrically conductive material and are configured to form a portion of an interlock circuit, as will be explained below. As shown in FIG. 7, the illustrated intermediate terminals 47 are generally flat members that each defines a first end having a split or forked portion and a second end having a blade portion. Referring back to FIG. 2, the intermediate terminals 47 can be individually disposed within the passageways 46 such that the blade portions extend through the bottom surface of the respective side wall 43. It should be appreciated that the intermediate terminals 47 may be configured in any suitable manner for a desired application or to accomplish a desired purpose.

Referring to FIGS. 2 and 7, the intermediate liner assembly 40 may also include a wedge member 48 for securing the intermediate terminals 47 within the passageways 46. As shown in FIG. 7, once the intermediate terminals 47 are received within the passageways 46, the wedge member 48 is inserted into the receptacle 45 and secured in place by a conventional retention structure, such as a plurality of resilient tabs (not shown). Referring back to FIG. 2, the wedge member 48 can engage a top surface of the intermediate terminals 47 for securing the intermediate terminals 47 within the passageways 46. Alternatively, it should be fully appreciated that the intermediate terminals 47 may be secured within the passageways 46 in any manner. For example, the intermediate terminals 47 can be integrally molded within the passageways 46 or can be secured therein by providing a door and hinge configuration on the bottom surface of the respective side wall 43. The wedge member 48 may define a longitudinally extending slit or individual thru-holes that downwardly extend through the wedge member 48, the purposes of which will be explained below.

As shown in FIG. 7, the illustrated housing portion 41 also includes an optional adaptor 49. The adaptor 49 can be used to assist in the removal of the intermediate liner assembly 40 from the opening 11*a* in the panel 11. The illustrated adaptor 49 is a protrusion that extends outwardly from the top surface 42 of the housing portion 41. Thus, a conventional hand tool (not shown), such as a pair of pliers or the like, can be used to grasp the adaptor 49 and provide a sufficient pulling force on the housing portion 41 for removal from the opening 11*a*. Alternatively, the adaptor 49 can be any suitable structure for applying a sufficient pulling force to the housing portion 41, including but not limited to a handle, knob, clasp, or the like.

Referring back to FIG. 2, the illustrated interlock 20 further includes a printed circuit board (PCB) 50. The PCB 50 is, in large part, conventional in the art and can be embodied as a generally flat substrate formed from an electrically insulating or non-conductive material, such as fiberglass or the like, that is suitable for supporting one or more electrical components of the electrical system 10. As will become apparent, the desired electrical component can be supported by the PCB 50 in any manner that provides access thereto through the opening 11*a* of the panel 11. It should be appreciated, however, that the desired electrical component may be supported by panel 11 and electrically connected to the PCB 50 if so desired.

The PCB 50 may also be configured to electrically connect the desired electrical component with the electrical system 10 using, for example, any number of conductive pathways (now shown). As such, the conductive pathways can be made of any conductive material, such as copper or the like, and etched or otherwise laminated on the substrate. In other embodiments, the PCB 50 can be any structure configured to support and electrically connect the desired electrical component with the electrical system 10 as described herein and below.

Figure 5:
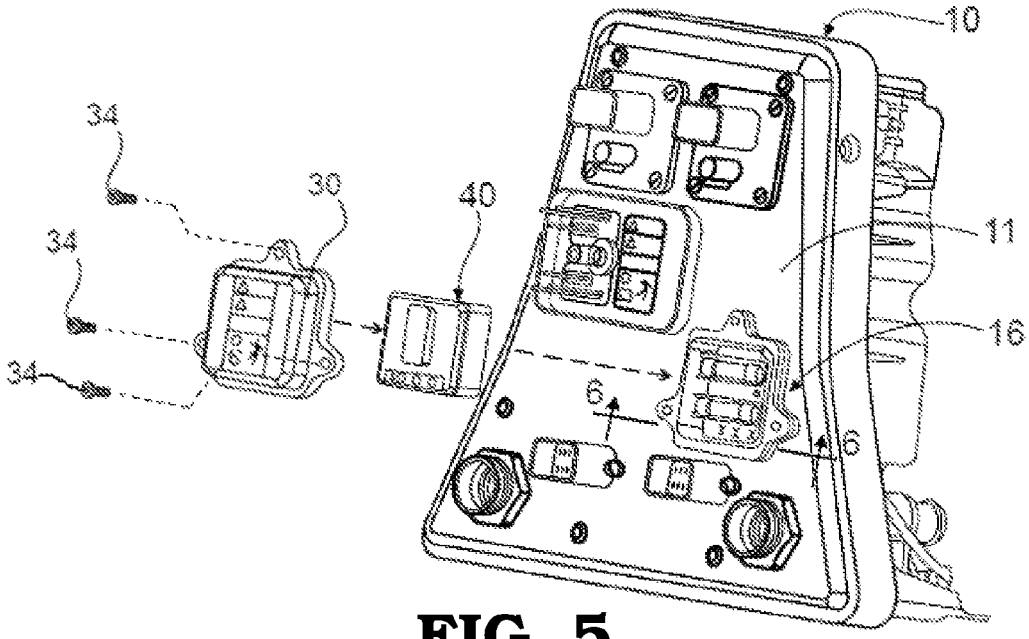
FIG. 5 is an exploded perspective view of the electrical system illustrated in FIGS. 1 through 4 showing the interlock in a fully disassembled and open circuit position.
Figure 6:
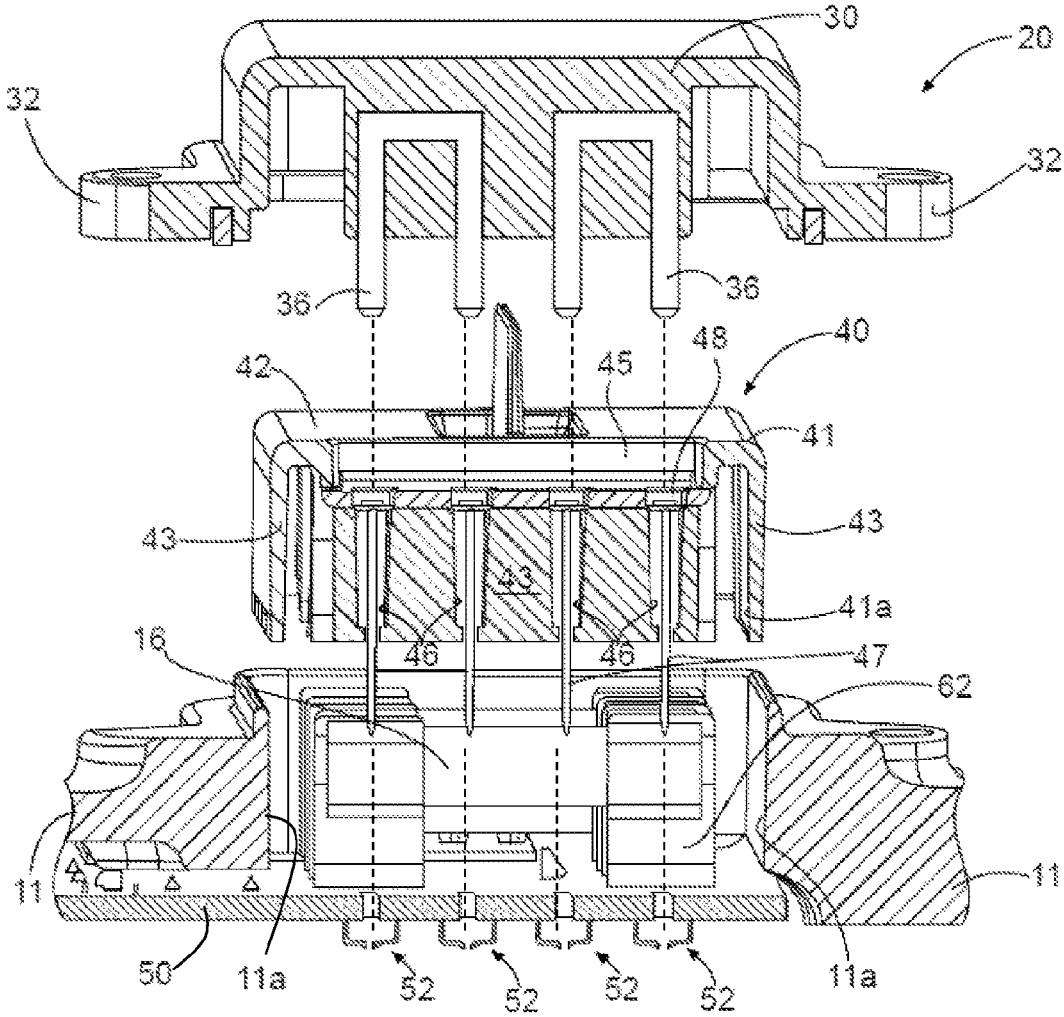
FIG. 6 is an enlarged sectional elevational view of a portion of the interlock taken along line 6-6 of FIG. 5.

As best shown in FIGS. 5 and 6, the desired electrical component may be embodied as a pair of fuses 16 removably mounted to the PCB 50, although any number of fuses 16 may be used. The fuses 16 can be any over-current protection device configured to provide electrical continuity between the power source 12 and a desired portion of the electrical system 10. Each of the illustrated fuses 16 is a conventional glass tube fuse that defines an elongated, cylindrical body terminating in a pair of electrically conductive end caps. For example, the fuses 16 can be a standard 20 amp glass tube fuse, but is not so limited. Alternatively, the fuses 16 can be embodied as any other type of fusible link or fuse limiter. Further, as briefly described above, the interlock 20 can provide access to any desired electrical component of the electrical system 10 and, as such, is not limited to the embodiment described and illustrated herein.

As shown in FIG. 6, each of the fuses 16 can be removably mounted to the PCB 50 by a pair of fuse terminals 62. The fuse terminals 62 are configured to receive and support the end caps of the respective fuse 16. The illustrated fuse terminals 62 define a base portion secured to the PCB 50 and a pair of flexible posts that extend from the base portion so as to form a generally u-shaped configuration. The end caps of the fuse 16 are inserted between the flexible posts for frictional engagement with the fuse terminals 62. It should be understood that the fuse terminals 62 are also configured to provide electrical continuity between the PCB 50 and the fuse 16. Thus, the fuse terminals 62 can be formed from any electrically conductive material, including but not limited to metallic materials such as copper and the like. It should also be appreciated that each fuse 16 and the respective fuse terminals 62 can be configured in any manner for a desired application.

Referring back to FIG. 2, a plurality of electrically conductive base terminals, indicated generally at 52, can be mounted to the PCB 50. The base terminals 52 are configured to form an interlock circuit with the intermediate terminals 47 and the shorting bars 36, as will be further explained below. The illustrated base terminals 52 are embodied as bottom entry-type electrical terminals that are, in large measure, conventional in the art and extend from a bottom surface of the PCB 50. As such, each of the individual base terminals 52 can include a plurality of support legs 54 for supporting the base terminal 52 to the PCB 50. Each base terminal 52 also defines an aperture having a pair of opposing tabs 56 for receiving and frictionally engaging the intermediate terminals 47 so as to provide an electrical connection therewith, as will be described below. Thus, the base terminals 52 can be formed from any electrically conductive material, including but not limited to metallic materials such as copper and the like. Further, it should be appreciated that the base terminals 52 may be configured in any manner for a desired application.

Accordingly, the PCB 50 may define any number of thru-holes that are vertically aligned, respectively, with the apertures of the base terminals 52. Thus, the blade portions of the intermediate terminals 47 can extend through the PCB 50 for engagement with the base terminals 52 when the intermediate liner assembly 40 is secured to the panel 11, as will be further explained below.

The operation of the interlock 20 will now be described. As shown in FIGS. 1 and 2, the interlock 20 is initially in the fully assembled and closed circuit position. In this position, the intermediate liner assembly 40 is secured within the opening 11*a* of the panel 11 and the external cover 30 is secured to the panel 11. The distal ends of the shorting bars 36 extend through the receptacle 45 and the passageways 46 of the intermediate liner assembly 40 into frictional engagement with the split portions of the intermediate terminals 47. The blade portions of the intermediate terminals 47 extend through the PCB 50 into engagement with the base terminals 52. Thus, when the interlock 20 is in the closed circuit position, the power source 12 is connected to the electrical system 10.

Figure 3:
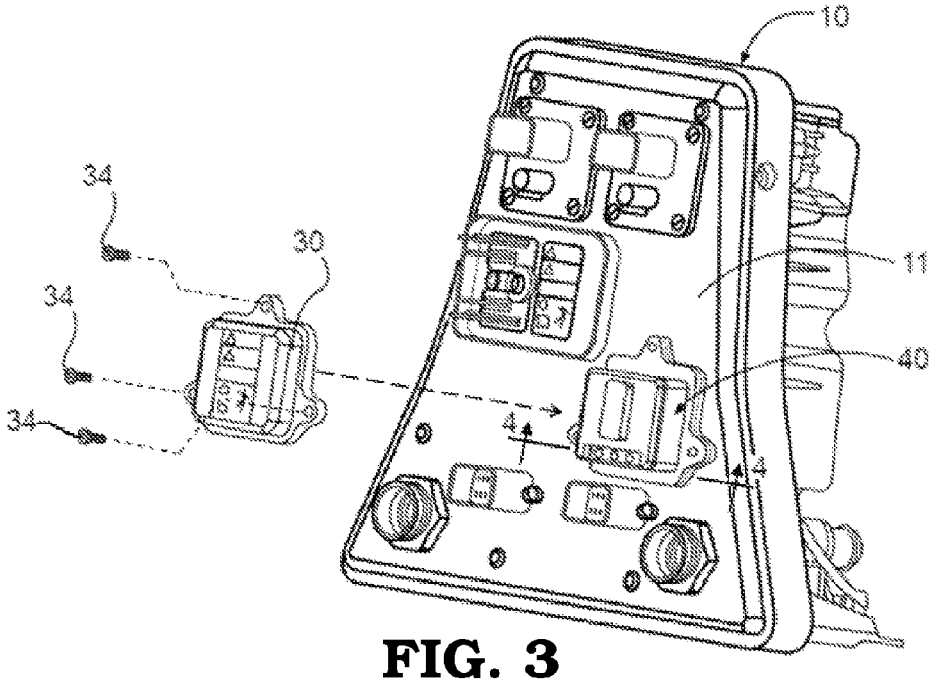
FIG. 3 is an exploded perspective view of the electrical system illustrated in FIGS. 1 and 2 showing the interlock in a partially disassembled and open circuit position.
Figure 4:
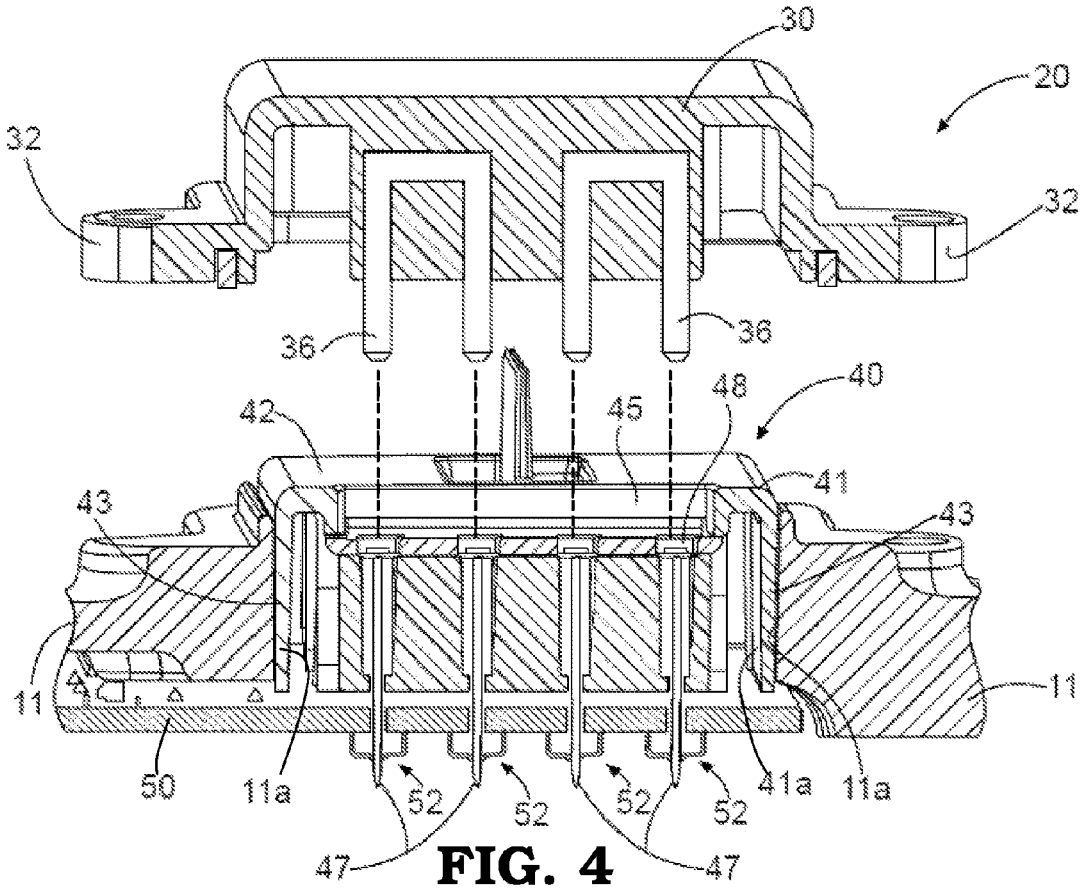
FIG. 4 is an enlarged sectional elevational view of a portion of the interlock taken along line 4-4 of FIG. 3.

In FIGS. 3 and 4, the electrical system 10 is illustrated with the interlock 20 in a partially disassembled and open circuit position. As shown therein, the external cover 30 is removed from the panel 11, thereby exposing the intermediate liner assembly 40. To remove the external cover 30, the fasteners 34 can be removed in any manner, such as with a conventional screwdriver (not shown) or the like. Once the fasteners 34 are removed, the external cover 30 can be detached from the panel 11 in any manner, such as by hand for example. When the cover 30 is removed from the panel 11, the distal ends of the shorting bars 36 are moved out of engagement with the intermediate terminals 47. As a result, an open circuit position occurs. In this open circuit position, the interlock 20 disconnects the power source 12 from the electrical system 10. Notwithstanding this, however, some or all of the components of the electrical system 10 may still store electrical energy therein as described above.

Referring now to FIGS. 5 and 6, the electrical system 10 is illustrated with the interlock 20 in a fully disassembled and open circuit position. This position occurs when both the external cover 30 and the intermediate liner assembly 40 are removed from the panel 11. Such removal provides access to the components of the electrical system, such as the pair of fuses 16. As briefly described above, a conventional hand tool (not shown), such as a pair of pliers or the like, can be used if necessary to remove the intermediate liner assembly 40 from the panel 11. The use of such tool causes a predetermined minimum amount of time to elapse, thereby allowing the components of the electrical system 10 to sufficiently discharge any stored electrical energy. For example, approximately five seconds may provide a sufficient amount of time for a typical three hundred volt power grid to discharge stored energy. However, the amount of time can be less than or greater than five seconds and can be based on a variety of factors, including for example capacitance of the electrical components.

In the illustrated fully disassembled and open circuit position, the shorting bars 36 of the external cover 30 and the intermediate terminals 47 of the intermediate liner assembly 40 are no longer engaged with the base terminals 52. As a result, the interlock 20 maintains the open circuit position and the power source 12 remains disconnected from the electrical system 10. The pair of fuses 16, or any other desired electrical component, may now be safely handled for servicing and/or replacement.

To reassemble the interlock 20, the intermediate liner assembly 40 can be first be secured within the opening 11*a* of the panel 11. Subsequently, the external cover 40 is secured to the panel 11. Once the interlock 20 is fully assembled as shown in FIGS. 1 and 2, a closed circuit position occurs and the interlock 20 allows the connection of the power source 12 to the electrical system 10. If the external cover 30 is installed on the panel 11 without the intermediate liner assembly 40 mounted therebetween, then the open circuit position of the interlock 20 will be maintained. As such, the illustrated embodiment ensures proper assembly and disassembly of the interlock 20.

Referring now to FIG. 8, one purpose of the controller 15 is to selectively connect and disconnect the power source 12 from the electrical system 10. As such, the controller 15 can be embodied as a conventional microprocessor or any other programmable device configured to accomplish the functions described herein. For example, in the illustrated embodiment, the controller 15 selectively connects the power source 12 in series with the fuse 16, the capacitor 14, and the high voltage device 13.

The controller 15 may also be configured to integrate the interlock 20 with the electrical system 10. For example, when the interlock 20 is in the fully assembled position, a closed electrical circuit is formed by the base terminals 52, the intermediate terminals 47, and the shorting bars 36. A common electrical current can be supplied through the electrical circuit. The controller 26 can be configured to monitor the circuit to ensure that the electrical current stays within predetermined limits. In doing so, the controller 15 is able to determine whether the interlock 20 is in the closed circuit position or the open circuit position. If it is determined that the interlock 20 is in the closed circuit position (as shown in FIGS. 1 and 2) then the controller 15 is adapted to connect the power supply 12 with the electrical system 10. If, on the other hand, it is determined that the interlock 20 is in the open circuit position (as shown in FIGS. 3 through 6) then the controller 15 is adapted to disconnect the power source 12 from the electrical system 10.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An interlock adapted for use with an electrical system comprising:

an electrical component that is supported on a support structure;

a first member that is removably secured to the support structure, the first member preventing contact with the electrical component while the first member is secured to the support structure; and a second member that is removably secured to the support structure, the second member preventing removal of the first member while the second member is secured to the support structure;

wherein the electrical component is adapted to be connected to a power source only when both the first member and the second member are secured to the support structure.

2. The interlock of claim 1, wherein a closed circuit is formed when the first member and the second member are secured to the support structure.

3. The interlock of claim 1, wherein each of the support structure, the first member, and the second member includes at least one pair of contact elements configured to form a closed circuit when the first member and the second member are secured to the support structure.

4. The interlock of claim 1, wherein the first member includes a first pair of contact elements that are adapted to engage a second pair of contact elements provided on the support structure when the first member is secured thereto.

5. The interlock of claim 4, wherein the second member includes a third pair of contact elements that are connected to one another and adapted to engage the first pair of contact elements of the first member when the second member is secured to the support structure.

6. The interlock of claim 3, wherein the contact elements of the support structure are electrical terminals each having an aperture.

7. The interlock of claim 3, wherein the contact elements of the first member are electrical terminals each having a split-portion and a blade portion.

8. The interlock of claim 3, wherein the contact elements of the second member are a shorting bar having a pair of blade portions.

9. The interlock of claim 3, wherein the contact elements of the support structure are electrical terminals each having an aperture, the contact elements of the first member are electrical terminals each having a split-portion and a blade portion, and the contact elements of the second member are a shorting bar having a pair of blade portions.

10. The interlock of claim 3, wherein the contact elements of the support structure are mounted to a circuit board.

11. The interlock of claim 3, wherein the contact elements of the first member are individually disposed within slits formed in the first member and secured therein by a wedge member.

12. The interlock of claim 3, wherein the contact elements of the second member are secured within a wall portion of the second member and extend outwardly therefrom.

13. The interlock of claim 1, wherein the electrical component is accessible through an aperture that is formed in the support structure.

14. The interlock of claim 13, wherein the first member is a housing that is removably secured within the aperture of the support structure.

15. The interlock of claim 13, wherein the first member is removably secured within the aperture of the support structure by a plurality of resilient tabs.

16. The interlock of claim 1, wherein the first member is removably secured to the support structure such that a predetermined minimum amount of time is required to remove the first member from the support structure.

17. The interlock of claim 1 further including a controller that is adapted to connect the power source with the electrical component when the first member and the second member are secured to the support structure.

18. The interlock of claim 17, wherein the controller is adapted to disconnect the power source from the electrical component when one of the first member and the second member is not secured to the support structure.

* * * * *